US005611816A

United States Patent [19]

Wasinger

[11] Patent Number: 5,611,816

[45] Date of Patent: Mar. 18, 1997

[54] PROCESS FOR DESIZING AND COLOR FADING GARMENTS

[76] Inventor: Eric Wasinger, 16403 Ledge Way, San Antonio, Tex. 78232

[21] Appl. No.: 626,850

[22] Filed: Apr. 3, 1996

[51] Int. Cl.[6] ..... D06L 3/04; D06L 1/14

[52] U.S. Cl. ..... 8/102; 8/111; 8/138

[58] Field of Search ..... 8/111, 107, 102, 8/138; 252/95; 510/302, 303

[56] References Cited

U.S. PATENT DOCUMENTS

| | | | |
|---|---|---|---|
| 3,650,667 | 3/1972 | Luechauer | 8/111 |
| 4,214,330 | 7/1980 | Thorsen | 8/149.2 |
| 4,300,367 | 11/1981 | Thorsen | 68/5 D |
| 5,118,322 | 6/1992 | Wasinger et al. | 8/111 |
| 5,261,925 | 11/1993 | Wasinger et al. | 8/111 |
| 5,342,415 | 8/1994 | Wasinger et al. | 8/111 |
| 5,376,143 | 12/1994 | Wasinger et al. | 8/111 |
| 5,471,692 | 12/1995 | Wasinger et al. | 8/159 |

*Primary Examiner*—Alan D. Diamond
*Attorney, Agent, or Firm*—John Lezdey

[57] ABSTRACT

A process for desizing and/or color fading of fabrics and garments utilizing ozone in the absence of steam or any substantial amount of water. The process includes treating the fabrics and garments in a closed chamber under slow rotation.

9 Claims, No Drawings

PROCESS FOR DESIZING AND COLOR FADING GARMENTS

FIELD OF THE INVENTION

The present invention relates to a process for desizing and/or the color fading of fabrics and garments. More particularly, there is provided a process for the simultaneous desizing and decolorizing of dyed fabrics and garments in a closed chamber under slow rotation utilizing ozone in the absence of steam or an aqueous medium.

BACKGROUND OF THE INVENTION

Garment and fabric processing today includes dyeing and desizing. Sizing is important in the fabric weaving and garment sewing processes. The size is usually removed in a finishing operation after the fabric is woven. In some fabrics e.g. Denim, the size is left in woven goods to give desirable properties to the denim garment so as to improve the wear properties of the fabrics or garments. However, if the garments or fabrics are further processed, for example, treated with a crosslinking agent and/or decolorized or finished in garment form, it is necessary to first remove the sizing.

The removal of sizing is today performed in most textile plants by one or more of the following methods. The primary method of desizing is enzymatically, for example utilizing amylolytic enzymes. In garment finishing this process is more costly. Mechanical action during garment desizing whereby abrasive drum linings in extractors and/or pumice stones are utilized to improve the garment softness and give the garment special features etc. Alkaline and acidic hydrolysis have also been employed but such techniques also cause chemical attack of the fabric so as to result in a loss of the tensile and tear strength of the fabric and/or garment. Oxidative desizing is generally employed using large amounts of sodium hypochlorite in solution. The use of hypochlorite creates environmental problems and further can significantly degrade the fabric. Desizing is required where the fabrics or garments are to undergo further processing such as dyeing, printing, decolorization, treatment with a crosslinker, ozone treatments and the like.

Garment dyeing technology, particularly with denim jeans, to achieve a differential color appearance has focused on treatments in which the dyer starts with a dyed garment and achieves a differential color effect by partial color removal. Removal of color is achieved by use of porous stones soaked in oxidizing agents, such as strong bleach or permanganates, and more recently, by after treatment with cellulose enzymes to remove fiber and thereby also remove some sizing.

U.S. Pat. No. 5,118,322 to Wasinger et al, which is incorporated herein by reference, relates to a process for decolorizing garments utilizing garments which are wetted and the garments are treated with ozone in combination with steam.

U.S. Pat. No. 4,283,251 in Singh discloses the bleaching of cellulosic pulp with gaseous ozone in an acidic pH followed by an alkaline treatment.

U.S. Pat. Nos. 4,214,330 and 4,200,367 to Thorsen, which are herewith incorporated by reference, describe a method and an apparatus for treatment of undyed fabrics with an ozone-steam mixture. The process is used to shrinkproof the fabric with a minimum amount of deterioration of the fabric fibers. The ozone treatment reacts with the undyed fibers and provides whiter fibers. The treatment is stated to increase subsequent dyeability and dye fastness of the garment.

W. J. Thorsen et al in their paper entitled, "Vapor-Phase Ozone Treatment of Wool Garments", *Textile Research Journal*, Textile Research Institute, 1979, pp. 190–197, describe the treatment of wool fabrics and garments with ozone and steam to provide shrink resistance to the fabric or garment. The process is based on the reaction of the ozone with the wool fibers.

It should be understood that the term "dye" as used herein is meant to include any of the materials which are used to provide a color to a fabric such as conventional dyes, pigments, or the like.

It should be understood that the term "ozone" as used herein denotes a preferable method of the invention and is meant to include ozone alone or ozone diluted with inert gases.

SUMMARY OF THE INVENTION

The present invention provides a process for the simultaneous desizing and/or decolorization of fabrics and garments containing cellulosic material, an ozone degradable colorant without steam or a substantial amount of water which comprises the steps of:

A. rotating said garments in a closed chamber without water at about 2 to 10 revolutions per minute; and B. contacting said fabrics or garments with ozone in the absence of steam or any additional water for a period of time prior to any substantial degradation of the fabrics or garments.

Generally, the fabrics or garments contain about 5 to 10% by weight of water, preferably about 8 to 10% by weight.

Advantageously, the fabrics or garments are in contact with the ozone for a period of about 2 to 10 minutes, preferably 2 to 5 minutes.

Advantageously, the fabrics or garments are washed after the ozone treatment.

Accordingly, the fabric with a portion of the sizing and dye removed requires less time and bleaching agent, oxidizing agent or reducing agent in order to produce a garment having a lighter shade of the original color and/or to produce a garment having the appearance of being "stone washed" or "acid washed".

It is therefore a general object of the invention to provide a means for simultaneously desizing and decolorizing a fabric or garment which has not been wetted.

It is yet another object of the invention to prepare a fabric or garment for further treatment by removal of a sizing agent with ozone.

It is yet still further object of the invention to selectively and/or evenly decolorize or fade dyed garments with ozone to produce fashion garments without water or steam.

It is a further object of the invention to prevent yellowing of fabrics and garments during storage.

DESCRIPTION OF THE PREFERRED EMBODIMENTS

Although specific terms are used in the following description for the sake of clarity, these terms are intended to refer only to the particular feature of the invention selected for illustration and are not intended to define or limit the scope of the invention.

According to the present invention, sized and/or dyed fabrics and garments which are required to be desized before undergoing further processing can be treated with an ozone so as to remove the sizing. If desired, such as in the case of denim jeans, where the present fashion requirement is a bleached or washed appearance, the garment can be simultaneously decolorized. Typically, blue jeans which would normally undergo desizing in a washer-extractor, can now undergo simultaneous desizing and decolorization by treatment with ozone without steam or in an aqueous medium.

In accordance with the invention jeans or fabrics which are dyed and sized are placed into a washer/extractor equipped with a source of ozone. The fabrics or jeans are not wetted. Typically, the washer/extractor is a 500 gal. rotary drum type which normally rotates about 27–32 revolutions per minute. However, the slower rotation has been found to reduce creasing which results in streaking since the ozone does not make complete contact. A rotation of the drum at about 2 to 10 rotations per minute in an ozone atmosphere for a period of time before any substantial degradation of the cellulosic material takes place has been found suitable for most treatments. The exposure to the ozone for dyed and sized blue jeans is about 2 to 10 minutes, preferably for about 2 to 5 minutes.

Typical commercial runs in a 500 gal. washer/extractor involves about 180 jeans.

The dye ozone process is to be understood as ozone gas that is used with fabric that contains less than 30% moisture and that the fabric feels sensibly dry to the touch even though it will contain about 5–10% moisture (preferably about 8–10% moisture).

Although starch based sizing products left on the cloth after weaving seem to give the most protection, other size materials such as polyvinyl alcohol, (PVA) partially hydrolyzed PVA, among others still afford some protection from damage to the garments when they are employed as the sizing material. Obviously, their ability to protect the textile components of the cloth improves if they are blended with the starch or starch derivative containing products.

Although the starch derived from the yellow dent corn is the primary type of pearl starch (or derivatized) that is employed as a sizing agent in the United States, the starches from other sources including but not limited to potato, sago, rice, wheat starches will work equally as well; as well genetic starches having either a high amylose or a high amylopectin content.

One such loom finished goods which uniquely lends itself to a dry ozone process is indigo dyed denim garments such as "Blue Jeans". Such garments are routinely manufactured from cloth in which the warp threads are most often protected with starch containing sizes during the weaving process and which have also been dyed with indigo prior to weaving. In such goods, the starch apparently also protects the filling threads from the damaging affects of the ozone, probably as the result of being in intimate contact with the warp threads. Usually the surface of the garment will have two to three warp threads at the fabric surface for each filling thread, depending upon whether or not the base fabric employs a 2/1 or 3/1 twill construction.

The dry ozone process of the present invention also seems to be quite effective when employed with other dye decolorizing systems. Typical of these are those employed in stone washing, ice washing, acid washing, etc. when potassium permanganate is used as the preferred bleaching agent and used to produce special looks or finish in a denim garment (blue jean). This look or finish can range from a very slight random bleaching affect to an almost complete bleaching (white out) of the original blue indigo dye in the garments.

An undesirable side affect with garments processed by this technique is the gradual yellowing of the whiter portion of the finished goods after they have been exposed to light (especially ultraviolet light). Since this is a very slow or gradual affect, the damage to the goods may not be found until after they have been shipped to the retailer or even after being purchased and are being worn by the consumer.

The causes for the yellowing is generally thought to be due to isatin and/or anthranilic acid or its derivatives which may be produced during the reaction with the permanganate solutions; although a number of other compounds are also present after the reaction (See example, James W. Rucker et al "Evaluation of Factors Contributing to the Light-Induced Yellowing of Whitewashed Denim: Part I" *Textile Chemist and Colorist* 24, (#9), 1992, p. 66 and Part II, *Textile Chemist and Colorist* 24, (#10) 1992, p 21). We have found that if the garments are treated with the ozone for a short time after the permangante treatment that the yellow coloration will not occur. As a consequence it is quite likely that the ozone destroys the yellow producing compounds just as it decolorizes the indigo dye. Thus an exposure of the permanganate treated fabrics to a dry ozone process can be used to prevent the yellowing from ever occurring.

It has also been suggested that the yellowing in the permanganate frosted garments can be caused by incomplete removal of the manganese dioxide or the divalent manganese in the neutralization and rinsing steps (See example A. H. Redies et al in *Textile Chemist and Colorist* 24 (#5) 1992, p. 26). Since ozone treatment results in oxidation of the manganese ion into a higher oxidative form rather than the dioxide form (a red brown color rather than the black oxide form is produced from the divalent manganese ions upon exposure to the dry ozone process), the causes for potential yellowing in the treated goods are apparently removed.

Additionally, the ozone treatment can be used to destroy any yellowing that may have already occurred as a result of the process. The yellowed garments when subjected to ozone will recover their original whiteness. Only a very short ozone treatment is required in each case, i.e., as a preventative or as a cure.

Often after the treatment and washing process, some dye that has been removed by other processes will re-deposit itself onto the garments. This is sometimes severe enough to require the need for rewashing the garments. In such cases, it has been found that a short treatment with the dry ozone will remove the deposition by decolorization thereby eliminating the need for rewashing, thus, saving the time and chemicals required for a rewash. This can be done typically with as little as a 2 minute dry ozone cycle. Under such conditions virtually no damage to the fabric occurs. On the other hand, if some abrasion is desired in order to duplicate the effects of stones, enzyme treatments or the like, the dry ozone will accomplish this with much the same look but at a much lower strength loss than will be obtained by the alternative treatments.

The ozone within the chamber is preferably measured periodically and kept at a minimal and within the range of about 10 to 100 mg per liter. The ozone can be generated by an ozone generator of the type available from Griffin Technics, Inc., Model GTC-2B which produces ozone from dry air or oxygen using electrical circuit breakers or Corona discharge. The ozone may be used alone or diluted with inert gases.

The type of dye used on the garments is not critical. It is only important that the dye is ozone reactive where intended. Cellulose substantive dyes, such as vat dyes, which are common in the garment industry, are preferably used. Exemplary of the dyes which are substantive to cellulose that can be used include Acid Light Scarlet GL, an acid levelling dye, Sevron Brilliant Red 2B, indigo vat dye, a cationic dye, Sulfonine Brilliant Red B, an anionic dye, Brilliant Milling Red B, C.I. Disperse Blue, pyrazolone azomethine dye, hydroxy azo dyes, or the like. Where the dye is a xanthene dye, treatment also gives rise to chemiluminescence in the process. Other suitable dyes that can be used are identified in the paper of Charles D. Sweeney entitled, "Identifying a Dye can be Simple or it Can Involve Hours of Laboratory Analysis", *Textile Chemist and Colorist*, Vol. 12, No. 1, January 1980, pp. 26/11.

The following examples are illustrative of the practice of the method of the present invention. It will be understood, however, that is not to be construed in any way limitative of the full scope of the invention since various changes can be made without departing from the spirit of the teachings contained herein the light of the guiding principles which have been set forth above. All percentages stated herein are based on weight except wherein otherwise noted.

EXAMPLE I 180 jeans (normal washer load) in their new condition and still containing their original starch sizing were treated in a typical 500 gal. capacity rotary drum washer/extractor unit with ozone for 5 minutes. The ozone concentration in the chamber reached about 40 mg/l . The drum rotation was slowed from the normal 27–30 rpm to 4 rpm to inhibit streaking. The color of the jeans after the treatment showed significant reduction in their original coloration. Longer treatments gave a further color reduction. The tensile strength of the jeans fabric was not appreciable degraded even in the filling direction until the treatment times of greater than 15 minutes was employed. At about a 15 minute reaction time, approximately 50% of the starch could be removed from the jeans by a 5 minute hot (180° F.) water extraction. Therefore, the starch is still in a form to offer continuing protection to the jeans. The results for various times of the dry ozone treatments are shown in Table 1.

TABLE I

Effect of Time of Dry Ozone Treatment on the Properties of Denim Jeans

| Treatment Time (min) | % Strength Loss | % Size Removal | % Color Loss |
|---|---|---|---|
| 5 | nil | ~5 | 10 |
| 10 | nil | ~20 | 20 |
| 15 | ~nil, ~3F | ~50 | 40 |
| 30 | ~3W ~5F | ~80 | 75 |

W = Warp,
F = Filling

From these results it is seen that the presence of the starch allows the ozone to affect a color loss without significant strength loss as compared to other processes.

EXAMPLE II 180 jeans that were showing significant dye redeposition were loaded into a washer/extractor unit and treated by the dry ozone process according to Example I for 2 minutes. The jeans were found to have an acceptable "pass" after this time. In severe cases, the jeans may require 3 minutes reaction time. Again the speed of the rotation was reduced to about 4 rpm during the ozone treatment.

EXAMPLE III

A. A pair of jeans that had been processed by a potassium permanganate treatment was steamed for 8 to 10 minutes in a laboratory steamer (autoclave) at 100° C. with saturated steam to accelerate the yellowing process. In this way a washer/extractor load of jeans that had the potential for high level of yellowing was identified. 90 pair of jeans from this load were subjected to a dry ozone treatment for 2–3 minutes following the procedure of Example I. Jeans from this batch along with jeans from the original batch that had not received the dry ozone treatment (i.e., the other 90 jeans) were packaged in the usual manner and stored under normal conditions for 9 months. The original jeans showed a high incidence of yellowing while the dry ozone treated jeans showed no yellowing at all.

B. In another experiment, the potential incidence of photoyellowing in a lot of permanganate treated jeans was determined by exposure of samples in an Atlas CXW #2 Sunshine Carbon Arc Weatherometer using glass filters. A lot of jeans that was identified as having a high potential for photoyellowing was similarly treated for 2–3 minutes and gave the same results as was obtained using the autoclave steaming method for the photoyellowing prediction.

EXAMPLE IV 90 pairs of jeans from a severely yellowed lot (supplied by Levi Strauss and Co.) were placed in a washer/extractor fitted for dry ozone and treated for 3 minutes following the procedure of Example I. The yellow color was removed by this treatment and did not reappear over the life of the garments.

These treatments show that the yellowing phenomena is prevented from occurring by a dry ozone treatment and can be used to treat all jeans to prevent the process from occurring on the few lots that would escape detection and cause return problems. Further, returned jeans can be salvaged by a dry ozone treatment of short duration.

EXAMPLE V

Whitewashed jeans by the potassium permanganate method and still containing a high level of permanganate were subjected to a dry ozone for 5 minutes following the procedure of Example I. The fabric became a deep reddish brown. The red manganese oxide color could be totally removed by a warm acid (0.5% acetic acid) wash. The fabric did not contain any manganese dioxide. Further, fabric treated by this method did not later develop any photoyellow coloration.

EXAMPLE VI

Jeans were treated with a 2% solution of a series of metallic salts. The jeans were then subjected to the dry ozone treatment ranging from 3 to 8 minutes following the procedure of Example I. The final color of the jeans were noted and are summarized in Table 2. The usual color of the oxide form of the salt differs in each case from the expected oxide salt obtained with peroxide or air oxidation. Thus offending ions that can result in discoloration of goods during storage can be eliminated by a dry ozone process.

TABLE 2

Effect of Ozone Treatment on Various Metallic Salts

| 2% Salt Employed | Treatment Time (minutes) | Oxide Color Obtained |
|---|---|---|
| Copper Sulfate | 3 | Light Green |
| Nickel Sulfate | 5 | Black |
| Cobalt Chloride | 5 | Brown |
| Ferrous Chloride | 5 | Pale Yellow Brown |
| Ferric Chloride | 3 | Yellow Brown |
| Manganese Chloride | 8 | Red Brown |

What is claimed is:

1. A process for desizing and/or decolorizing fabrics or garments containing about 5 to 10% by weight water, cellulosic material and an ozone degradable colorant in an environment that does not contain steam or any water in addition to said about 5 to 10% by weight, which comprises the steps of:

a) rotating said fabrics or garments in a closed chamber at about 2 to 10 revolutions per minute; and b) simultaneously contacting said fabrics or garments in said chamber with ozone in the absence of steam or any water in addition to said about 5 to 10% by weight for a period of time so as to desize and/or decolorize said fabrics or garments prior to any degradation of the fabrics or garments.

2. The process of claim 1 including the step of washing said fabrics or garments at an elevated temperature after step b.

3. The process of claim 2 including the step of subsequently contacting said fabrics or garments with ozone after said washing.

4. The process of claim 1 wherein said fabrics or garments contain about 8 to 10% by weight water.

5. The process of claim 1 wherein said fabrics or garments are in contact with said ozone for a period of about 2 to 10 minutes.

6. The process of claim 1 wherein said colorant is decolorized without bleaching said cellulosic material.

7. The process of claim 1 wherein said colorant is a dye.

8. The process of claim 7 wherein said dye is an indigo dye.

9. The process of claim 1 wherein said colorant is the result of a manganese ion.

* * * * *